US007673486B2

(12) United States Patent
Bayer et al.

(10) Patent No.: US 7,673,486 B2
(45) Date of Patent: Mar. 9, 2010

(54) PEENING CHAMBER FOR SURFACE PEENING, IN PARTICULAR FOR ULTRASONIC SHOT PEENING OF GAS TURBINE COMPONENTS

(75) Inventors: Erwin Bayer, Dachau (DE); Philipp Thuemmler, Munich (DE)

(73) Assignee: MTU Aero Engines GmbH, Munich (DE)

( * ) Notice: Subject to any disclaimer, the term of this patent is extended or adjusted under 35 U.S.C. 154(b) by 0 days.

(21) Appl. No.: 12/280,329

(22) PCT Filed: Feb. 15, 2007

(86) PCT No.: PCT/DE2007/000283

§ 371 (c)(1),
(2), (4) Date: Aug. 21, 2008

(87) PCT Pub. No.: WO2007/095903

PCT Pub. Date: Aug. 30, 2007

(65) Prior Publication Data

US 2009/0011686 A1 Jan. 8, 2009

(30) Foreign Application Priority Data

Feb. 22, 2006 (DE) ..... 10 2006 008 210

(51) Int. Cl.
*B21D 31/06* (2006.01)
*C21D 7/00* (2006.01)

(52) U.S. Cl. ..... 72/53; 29/90.7

(58) Field of Classification Search ..... 72/53; 29/90.7
See application file for complete search history.

(56) References Cited

U.S. PATENT DOCUMENTS

| | | | | |
|---|---|---|---|---|
| 4,355,488 | A | 10/1982 | Schmitz et al. | |
| 5,509,286 | A * | 4/1996 | Coulon | 72/53 |
| 5,950,470 | A * | 9/1999 | Prewo et al. | 72/53 |
| 6,170,308 | B1 * | 1/2001 | Veronesi et al. | 72/53 |
| 6,490,899 | B2 * | 12/2002 | Berthelet et al. | 72/53 |
| 6,837,085 | B2 * | 1/2005 | Berthelet et al. | 72/53 |
| 7,028,378 | B2 * | 4/2006 | Cheppe et al. | 29/90.7 |
| 7,300,622 | B2 * | 11/2007 | Lu et al. | 72/53 |
| 7,389,663 | B2 * | 6/2008 | Cheppe et al. | 72/53 |
| 2003/0115922 | A1 * | 6/2003 | Berthelet et al. | 72/53 |
| 2006/0021410 | A1 * | 2/2006 | Cheppe et al. | 72/53 |

FOREIGN PATENT DOCUMENTS

| | | |
|---|---|---|
| DE | 10 2004 029 546 A1 | 1/2006 |
| EP | 1 077 109 A2 | 2/2001 |
| FR | 2 689 431 A1 | 10/1993 |

* cited by examiner

*Primary Examiner*—David B Jones
(74) *Attorney, Agent, or Firm*—Crowell & Moring LLP

(57) ABSTRACT

The invention relates to a peening chamber for surface peening, in particular for ultrasonic shot peening of gas turbine components (10), which, at least with a component region (20) comprising the surface to be treated, are to be arranged within a chamber wall (12), which spatially defines the peening chamber, wherein at least one wall region (26, 36, 48) of the chamber wall (12) is designed to be adjustable in order to vary the geometry of the peening chamber.

18 Claims, 1 Drawing Sheet

PEENING CHAMBER FOR SURFACE PEENING, IN PARTICULAR FOR ULTRASONIC SHOT PEENING OF GAS TURBINE COMPONENTS

BACKGROUND AND SUMMARY OF THE INVENTION

This application claims the priority of International Application No. PCT/DE2007/000283, filed Feb. 15, 2007, and German Patent Document No. 10 2006 008 210.9, filed Feb. 22, 2006, the disclosures of which are expressly incorporated by reference herein.

The invention relates to a peening chamber for surface peening, in particular for ultrasonic shot peening of gas turbine components.

Such a peening chamber has already been known from document U.S. Pat. No. 6,490,899 B2, whereby, in the chamber, the tops of a plurality of turbine blades of a turbojet engine can be simultaneously surface-treated by peening.

By using such shot peening, it is possible, for example by abrasion or the like, to harden heavily stressed components and component sections of gas turbines. Likewise, by using this special surface-treatment process, it is possible to minimize, or at most eliminate, distortions, material movements or other defects, for example on the edges of rotors or in blade areas. Finally, shot peening can be used to post-treat gaps at joints of repaired turbine blades or similar components.

Referring to the known peening chamber, the plurality of turbine blades are to be positioned head first inside an accommodation frame in such a manner that their blade tips comprising the surface to be treated project through an associate wall orifice inside the frame. In so doing, the frame itself forms a horizontally extending upper wall region of the peening chamber, the wall region being located opposite and parallel to a sonotrode's vibrating plate extending in a horizontal direction and forming the lower wall region of the peening chamber. In so doing, the frame is to be fixed in place in an associate frame opening in such a manner that the blade tips comprising the surfaces to be treated are located inside the peening chamber. Now, by using the sonotrode that has been excited by ultrasonic vibrations, a bead cloud can be generated inside the peening chamber, the bead cloud being used for the surface treatment of the blade tips of the turbine blades.

Furthermore, German Patent Document No. DE 10 2004 029 546 A1 has disclosed a peening chamber, in which a blade root of a gas turbine blade can be treated by means of an ultrasonic shot peening process. To do so, a passage opening is provided inside a vertically extending wall region of the peening chamber, in which case the gas turbine blade is to be pushed through the passage opening. A horizontally extending lower wall region of the overall essentially cube-shaped peening chamber is formed by a surface of a sonotrode that is to be excited by ultrasonic vibrations. As a result of this, the steel beads arranged inside the peening chamber are accelerated for the treatment of the blade root.

The disadvantage of each of these known peening chambers must be considered to be the circumstance that they are adapted quite specifically to one situation of application or to the treatment of a specific component. Consequently, the geometric configuration of the peening chambers is adapted to the component to be treated or to the component area to be treated in such a manner that a desired quality of the treated surface can be achieved. In addition, wall openings are provided in the respective wall region of the chamber wall or of the accommodation frame, the openings being specifically adapted to the cross-section of the component to be treated.

Therefore, it is the object of the present invention to improve a peening chamber of the aforementioned type in such a manner that the chamber can be adapted, with minimal expense and effort, to various components that are to be treated.

Referring to the peening chamber in accordance with the invention, at least one wall region of the chamber wall is designed so that it can be adjusted in order to change the geometric configuration of the chamber. In other words: the invention is based on the basic idea that the geometric configuration—namely, for example, the size and/or shape—of the peening chamber can be adapted or adjusted to the component to be treated, in that at least one wall region of the chamber wall is designed so as to be adjustable. As a result of this, it is not only possible to adapt or adjust the peening chamber to the different sizes of the components to be treated, but, rather—as a result of appropriate adjustments of the at least one wall region of the chamber wall—it is also possible, for example, to influence the distances and angles, at which the peening agent—for example, the beads in ultrasonic shot peening—will be deflected.

In the end, it is thus possible to produce a universally usable peening chamber that can be automatically adapted or adjusted—with extremely minimal expense and effort for setup—to various contours or components. Consequently, it is possible, in a simple manner, to treat components having different shapes and sizes inside one and the same peening chamber.

To accomplish this, the wall regions of the chamber wall that are to be adjusted can be slid in a linear direction, their angles may be adjusted, or they may be changed creating a different free form area, depending on the geometric configuration of the peening chamber that is optimal for the respectively to be treated component.

Referring to another embodiment of the invention, in particular one adjustment of the geometric configuration of the peening chamber has been found to be particularly easy to implement, i.e., in that at least one wall region of the chamber wall can be changed by being inflated. Consequently, it is possible to change the contour of the appropriate chamber wall by simply introducing or evacuating a gaseous medium. In so doing, it is conceivable, for example, to design the wall region or the chamber wall itself as an inflatable cushion. Likewise, it would also be conceivable to support the adjustable wall region with an inflatable cushion, thus permitting an appropriate adjustment of the wall region. Instead of a gaseous medium, it would also be conceivable, of course, to adjust the variable wall region of the chamber wall, for example, with the use of a liquid medium such as oil or the like.

Referring to another embodiment of the invention, it is further conceivable to design the chamber wall of the peening chamber of a flexible, elastic material and, in particular, of a rubber material. The side facing the component region must be appropriately sturdy on the chamber wall in order to be able to withstand, for example, the stress due to the beads used in ultrasonic shot peening. Furthermore, the chamber wall must also be stiff, so that, for example, the beads are deflected by the chamber wall in the desired manner. In conjunction with this, it is possible, for example, to provide the chamber wall—on its side facing the component region to be treated—with a cover or sheeting or the like, i.e., at least locally.

In order to be able to treat various components with the use of a single peening chamber, whereby only one component region comprising the surface to be treated is arranged inside the chamber wall or the peening chamber, it has been found to be particularly favorable—considering a further embodiment of the invention—to design the wall region of the chamber wall adjacent to the wall opening so as to be adjustable. In other words: it is also possible to provide the adjustable wall region of the chamber wall in accordance with the invention only in the region of the wall opening, through which the component region comprising the surface to be treated is passed. In conjunction with this, it is conceivable that only a part of the wall region surrounding the wall opening or also the entire peripheral wall region can be adjusted. Thus, in the end, the wall opening can be adjusted and adapted, in a simple manner, to varying sizes and geometric configurations of different components that are to be treated. As a result of this, it is not only possible to achieve a universally useable peening chamber but, beyond that, it is possible to reduce to a minimum the setup times used for the adjustment to a different component geometry.

In order to prevent peening agent from escaping between the wall opening and the component inserted therein, it has been found to be advantageous in a further embodiment of the invention to design the wall region of the chamber wall adjoining the wall opening as a seal. In addition to avoiding a loss of peening agent, it can thus be achieved that the surface that is to be treated can be precisely defined, or the component region to be treated can be separated extremely precisely from the component region that is not to be treated.

If, beyond that, a sliding element is provided in the contact region of the seal at the site where the component is passed through the wall opening, it is possible—in a simple manner—to move, for example rotate, the component inside the peening chamber during surface peening in order to achieve the best possible surface of the component.

In order to achieve a particularly good surface result, in particular with shot peening, it has further been found to be advantageous to provide or arrange an ultrasonic sonotrode, in particular inside the peening chamber. Referring to a particularly preferred embodiment, the surface of the sonotrode forms a wall region of the chamber wall.

Referring to the preferred embodiment, the at least one wall region that can be adjusted in order to change the geometric configuration of the peening chamber is different from the ultrasonic sonotrode, that is, in particular, also when one surface of the sonotrode forms a wall region of the chamber wall.

If a device for the detection of a sound emission of the peening agent is provided inside the peening chamber, the loss of peening agent—due to the concomitant change of the sound emission—can be detected in a simple manner in this way.

Furthermore, it has also been found to be advantageous if the peening chamber is associated with a device for metered replenishing of the peening agent present inside the peening chamber. As a result of this, it is possible to keep the amount of peening agent inside the peening chamber constant and to achieve, accordingly, a reproducible and highly consistent peening result.

Finally, a particularly advantageous peening chamber can be achieved in that the device for metered replenishing is connected to the device for detecting the sound emission of the peening material. If, in accordance with this, a loss of peening agent is detected by means of the device for the detection of a sound emission, this loss can easily be compensated for by the device for metered replenishing in order to ensure a uniform and reproducible peening result.

Additional advantages, features and details of the invention are provided from the following description of a preferred exemplary embodiment and from the drawings.

DETAILED DESCRIPTION OF THE DRAWINGS

Figure 1:
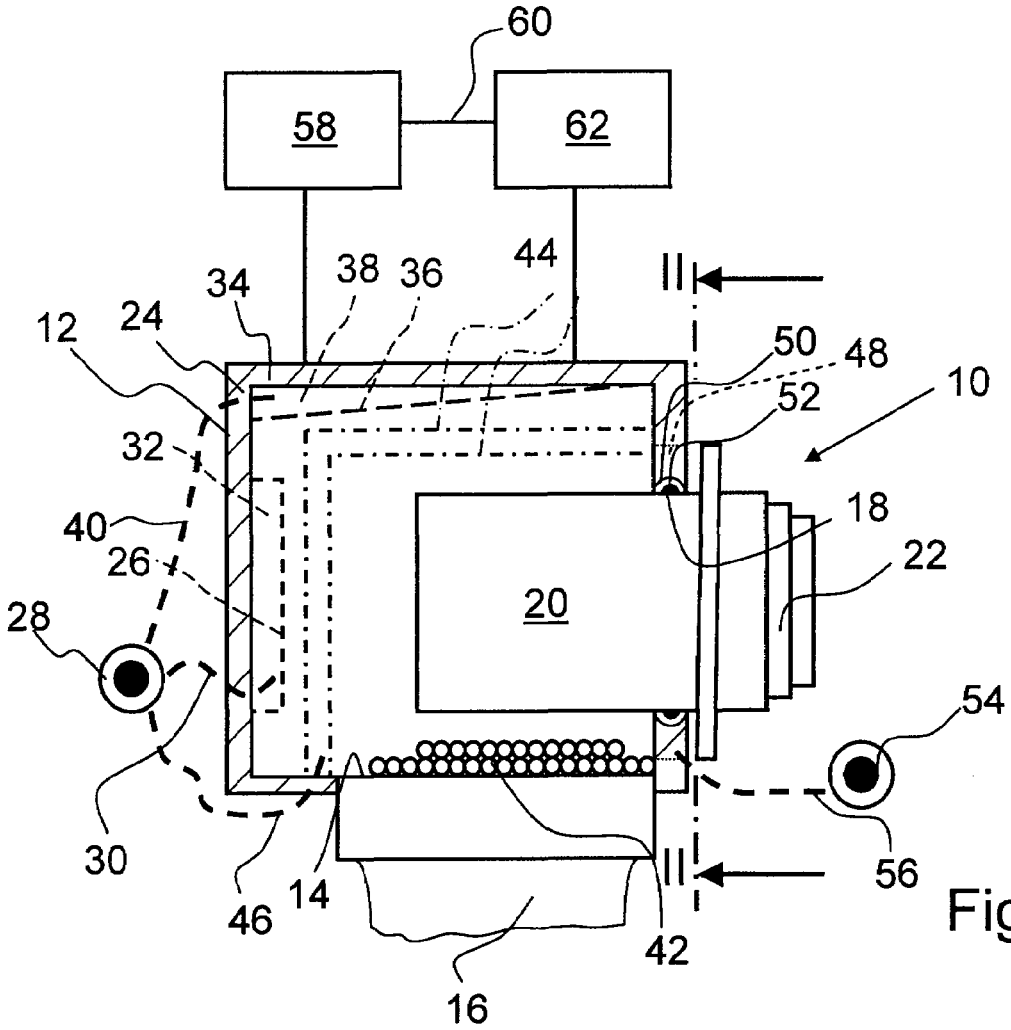
FIG. 1 is a schematic view of a section through the inventive peening chamber for surface peening, the chamber comprising a wall opening inside the chamber wall, through which opening a component region of a turbine blade is passed and positioned inside the peening chamber, whereby, for changing the geometric configuration of the peening chamber, for example, several wall regions of the chamber wall are designed so as to be adjustable.

FIG. 1 is a schematic sectional view of a peening chamber for surface peening, whereby in this case, the peening chamber is designed, in particular, for ultrasonic shot peening of gas turbine components in the form of engine blades 10. In the present case, the peening chamber has an essentially cubic geometric configuration, the chamber being essentially delimited by a chamber wall 12. On its horizontal lower side, regions of the peening chamber are delimited by a surface 14 of an ultrasonic sonotrode 16, whereby the sonotrode can be caused to vibrate via a not illustrated ultrasonic vibrating unit comprising, for example, an ultrasonic piezo actuator. The ultrasonic sonotrode 16 is operated, for example, at a frequency greater than 20 kHz and an amplitude within the range of approximately 30 to 60 μm. Of course, operation of the ultrasonic sonotrode 16 is not restricted to the stated frequency and amplitude ranges.

Inside the chamber wall 12 is a wall opening 18, through which a component region 20 of the engine blade 10 comprising the surface to be treated is passed or positioned inside the peening chamber. In the present case, the component region 20 located inside the peening chamber is the blade pan of the turbine blade 10, whereas the blade root 22 is located outside the peening chamber.

In order to be able to surface-peen the turbine blades 10 or other gas turbine components having different shapes or dimensions inside the peening chamber, the geometry of the peening chamber can be varied. In this context, variability of the geometry is understood to mean that, for example, individual wall regions can be moved in a manner that will later be explained in detail, so that the size and/or form of the peening chamber can be varied and, thus, be optimally adapted to the gas turbine component that is to be treated.

For example, FIG. 1 indicates—in dashed lines—a wall region 26 on the outside 24 of the chamber wall 12 facing away from the wall opening 18, whereby the wall region 26 can be adjusted linearly in a horizontal direction. As a result of this, it is possible, for example, to move the vertical wall region 26 located opposite the turbine blade 10 closer toward the component region 20 that is to be treated, or away from the component region. Referring to the present exemplary embodiment, the movement or adjustment of the wall region 26 is accomplished by means of a pressurized air source 28 and a feed line 30, via which a cushion-shaped element 32 supporting the wall region 26 can be inflated. When the wall region 26 is being moved back, the pressurized air can be discharged or evacuated accordingly. For example, the wall region 26 may be a plate-shaped element that is supported by the cushion-shaped element 32.

In particular, it is also conceivable, however, that the cushion-shaped element 32 consists of the wall region 26 itself or that the cushion-shaped element 32 is disposed around the wall region 26. In so doing, the wall region 26 and the cushion-shaped element 32, respectively, consist of a flexible, elastic material, in particular a rubber material, the material, of course, needing to be able to withstand the mechanical and thermal stresses inside the peening chamber. In conjunction with this, it would be conceivable, for example, to provide the cushion-shaped element 32 or the wall region 26 with a coating or covering in order to be able to provide, in particular, the required mechanical and thermal quality properties.

On the horizontal upper side 34 located opposite the ultrasonic sonotrode 16, another wall region 36 of the chamber wall 12 is shown as an example, whereby the wall region's angle setting can be adjusted. To do so, again a cushion-shaped element 38 positioned behind the wall region 36 is connected to the pressurized air source 28 via a feed line 40. Again, it is also conceivable that the cushion-shaped element 38 itself forms the wall region 36. By adjusting the angle of the wall region 36 it is possible, in particular, to deflect the peening agent, for example, the beads 42 at an appropriate angle during ultrasonic shot peening and to direct the agent at the component region 20 of the turbine blade 10 to be treated.

Furthermore, the dashed lines 44 in FIG. 1 show that the entire chamber wall 12 can also be made of a flexible, elastic material, in particular, a rubber material. In other words: considering this, the chamber wall 12 can be designed as a cushion-shaped element, in which case the chamber wall 12 may comprise one or more cushion chambers that are optionally to be filled individually. Referring to the present exemplary embodiment, the chamber wall 12 can be varied overall regarding its size via a feed line 46. If, however, the chamber wall 12 is divided into several cushion chambers, the chamber wall 12 can be varied not only regarding its size but also regarding its geometry in that the individual cushion chambers are filled at different levels with pressurized air from the pressurized air storage 28. In so doing, the chamber wall 12 can be provided, on its interior side delimiting the peening chamber, with linings or coatings in order to be able to withstand the thermal and mechanical stresses generated by the beads 42 during ultrasonic shot peening.

Figure 2:
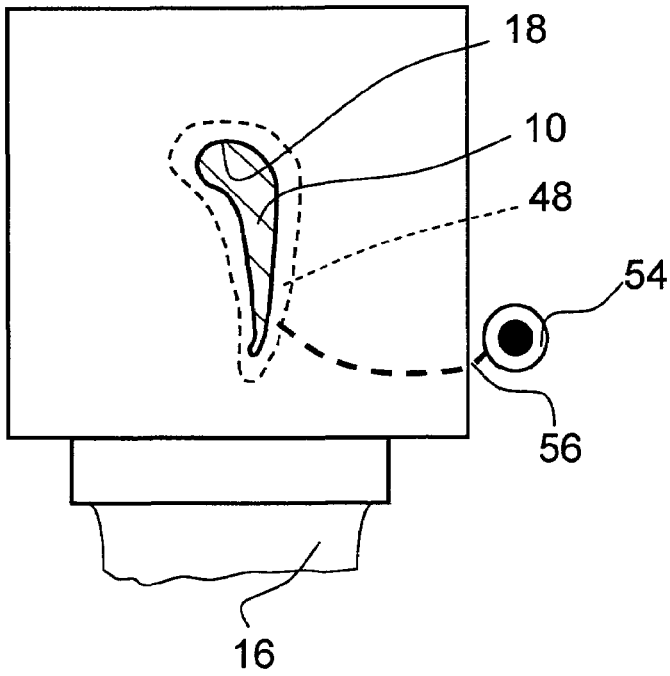
FIG. 2 is a schematic side view of the peening chamber in accordance with FIG. 1 in the region of passage of the turbine blade through the wall opening inside the chamber wall itself, whereby the turbine blade is schematically represented in a sectional view along line II-II in FIG. 1.

Viewed in conjunction with FIG. 2, which shows a schematic side elevation of the chamber wall 12 delimiting the peening chamber, the passage of the component region 20 of the turbine blade 10 indicated along line II-II in FIG. 1 is better recognizable. In particular, it can be seen that the peripheral wall region 48 (FIG. 2) adjacent to the wall opening 18 is also designed in an adjustable manner. To do so, the wall region 48 is designed as a cushion-shaped element which can be adjusted to vary the size and geometric configuration of the wall opening 18. To accomplish this, the wall region 48, in turn, is made of a flexible, elastic material, in particular a rubber material. In so doing, the wall region 48 forms a schematically indicated seal 50 relative to the engine blade 10 passed through the wall opening 18, the seal being disposed to prevent the escape of the beads 42 present inside the peening chamber. Furthermore, the adjustable wall region 48 comprises, in the contact area of the seal 50, an also schematically indicated peripheral sliding element 52, which can be used, for example, to shift or rotate the turbine blade 10 inside the wall opening 18. In order to position the turbine blade 10 inside the peening chamber, the wall opening 18 is preferably first adjusted in such a manner that the wall opening is larger than the internal diameter of the turbine blade 10. After the turbine blade has been positioned in the peening chamber, the wall region 48 is appropriately inflated until the desired seal against the escape of beads 42 is achieved between the turbine blade 10 and the chamber wall 12. The cushion-shaped wall region 48 is inflated via a feed line 56 supplied by a pressurized air source 54.

If the chamber wall 12—as indicated by lines 44—is overall made of a flexible, elastic material, the wall region 48 surrounding the wall opening 18 may, of course, itself be the chamber wall 12. In other words: it is also conceivable to create an overall chamber wall 12 to be filled with gas, the chamber wall then adapting to the turbine blade 10.

In all, it needs to be made clear that the previously described adjustable wall regions 26, 36 and 48 can be provided separately, as well as together, inside the peening chamber. Likewise, it is conceivable to combine a combination of a chamber wall 12 to be filled with air—in accordance with lines 44—with a wall region 26, 36 and 48 to be separately filled.

In order to be able to detect a loss of beads 42 or a similar peening agent inside the peening chamber, a device 58 for the detection of sound emission is arranged inside the peening chamber of the present exemplary embodiment. If, in so doing, a loss of beads 42 is detected, the device 58 is connected via a line 60 to a device 62 for the metered replenishing of beads 42 present inside the peening chamber. As a result of the potentially required replenishing of beads 42 by means of the device 62 it is ensured that a consistent amount of beads 42 or a similar peening agent is present in the peening chamber, so that an extremely consistent and easily reproducible surface result can be achieved, even when a plurality of turbine blades 10 is concerned.

The invention claimed is:

1. A peening chamber for ultrasonic shot peening of a component, comprising a chamber wall, the chamber wall spatially defining the peening chamber, wherein a wall region of the chamber wall is adjustable such that a geometry of the peening chamber is variable and wherein the wall region is adjustable by being inflated or filled with a fluid or a gas and wherein the chamber wall defines a wall opening wherein a wall region of the chamber wall adjacent to the wall opening is adjustable.

2. The peening chamber in accordance with claim 1, wherein the chamber wall is made of a flexible, elastic material.

3. The peening chamber in accordance with claim 1, wherein the wall region of the chamber wall adjacent to the wall opening forms a seal relative to a component disposed through the wall opening, the seal preventing an escape of peening material present inside the peening chamber.

4. The peening chamber in accordance with claim 3, further comprising a sliding element in an area of contact of the seal with the component disposed through the wall opening.

5. The peening chamber in accordance with claim 1, further comprising an ultrasonic sonotrode for acceleration of a peening agent inside the peening chamber.

6. The peening chamber in accordance with claim 5, wherein the peening agent is a bead.

7. The peening chamber in accordance with claim 1, wherein the component is a gas turbine component.

8. A peening chamber for ultrasonic shot peening of a component, comprising:

a chamber wall, the chamber wall spatially defining the peening chamber, wherein a wall region of the chamber wall is adjustable such that a geometry of the peening chamber is variable and wherein the wall region is adjustable by being inflated or filled with a fluid or a gas; and a detection device coupled to the peening chamber, wherein the detection device detects a sound emission of a peening material.

9. A peening chamber for ultrasonic shot peening of a comprising:

a chamber wall, the chamber wall spatially defining the peening chamber, wherein a wall region of the chamber wall is adjustable such that a geometry of the peening chamber is variable and wherein the wall region is adjustable by being inflated or filled with a fluid or a gas; and a metered replenishment device coupled to the peening chamber, wherein the replenishment device replenishes a peening material inside the peening chamber.

10. The peening chamber in accordance with claim 9, wherein the metered replenishment device is coupled to a detection device and wherein the detection device detects a sound emission of a peening material.

11. A peening chamber for ultrasonic shot peening of a component, comprising:

a chamber wall, the chamber wall spatially defining the peening chamber, wherein a wall region of the chamber wall is adjustable such that a geometry of the peening chamber is variable, wherein the wall region is adjustable by being inflated or filled with a fluid or a gas, wherein the chamber wall is made of a flexible, elastic material, and wherein the material is a rubber material.

12. A method for configuring a peening chamber for ultrasonic shot peening of a component, comprising the steps of:

adjusting a geometry of the peening chamber by inflating a wall region of a chamber wall that spatially defines the peening chamber with a fluid or a gas.

13. The method in accordance with claim 12, wherein the wall region includes a cushion chamber and wherein the cushion chamber is inflated.

14. The method in accordance with claim 12, wherein the step of inflating the wall region includes the step of linearly moving the wall region in a horizontal direction.

15. The method in accordance with claim 12, wherein the step of inflating the wall region includes the step of adjusting an angle setting of the wall region.

16. The method in accordance with claim 12, wherein the wall region defines a wall opening in the peening chamber.

17. The method in accordance with claim 16, wherein the step of inflating the wall region that defines the wall opening includes the step of forming a seal between the wall region and a component that is disposed through the wall opening.

18. The method in accordance with claim 12, further comprising the step of replenishing a peening material inside the peening chamber based on detecting a sound emission of the peening material.

* * * * *